US007716856B2

(12) United States Patent
Seipel

(10) Patent No.: US 7,716,856 B2
(45) Date of Patent: May 18, 2010

(54) CHALK SHOE

(76) Inventor: Stephanie Seipel, 16043 N. 138th La., Surprise, AZ (US) 85374

( * ) Notice: Subject to any disclaimer, the term of this patent is extended or adjusted under 35 U.S.C. 154(b) by 21 days.

(21) Appl. No.: 12/186,434

(22) Filed: Aug. 5, 2008

(65) Prior Publication Data

US 2010/0031536 A1 Feb. 11, 2010

(51) Int. Cl.
*A43B 23/00* (2006.01)

(52) U.S. Cl. ..... 36/136

(58) Field of Classification Search ..... 36/132, 36/136, 112

See application file for complete search history.

(56) References Cited

U.S. PATENT DOCUMENTS 1,751,069 A * 3/1930 Blain ..... 36/1
2,478,411 A * 8/1949 Martin ..... 36/1
3,174,234 A * 3/1965 Weitzner ..... 36/1
5,921,008 A * 7/1999 Ruff ..... 36/136
6,012,822 A * 1/2000 Robinson ..... 362/103
6,094,844 A * 8/2000 Potts ..... 36/136
6,898,875 B2 * 5/2005 Ruff ..... 36/136
7,596,891 B2 * 10/2009 Carnes et al. ..... 36/132
2005/0022431 A1 * 2/2005 Spitzer-Cohn ..... 36/98
2009/0013560 A1 * 1/2009 McKinney et al. ..... 36/98

FOREIGN PATENT DOCUMENTS

FR 2616047 A1 * 12/1988 ..... 36/73

* cited by examiner

*Primary Examiner*—Jila M Mohandesi

(57) ABSTRACT

The present disclosure relates to a shoe with a piece of removable chalk embedded into the front toe portion of a shoe's sole. The forefront sole of the shoe includes an opening sized for receiving a piece of chalk, intended for the wear to go from walking to drawing with a tilt of the foot. The wearer can cause the chalk to make contact with a surface by applying light pressure and tilting the toe of the shoe slightly toward the ground.

2 Claims, 3 Drawing Sheets

CHALK SHOE

FIELD OF INVENTION

The present invention relates generally to being able to draw with a tilt of your toe when wearing a pair of shoes. More particularly the present invention relates to the field of art, or creative drawing on a sure using your shoes.

BACKGROUND OF THE INVENTION

Active footwear with a piece of chalk located in the toe was invented by the inventor with the help of her 10 year old son for a school science project. The chalk shoe is intended for children to draw or write on an outside surface such as a patio or driveway without using their hands. Drawing or writing with your shoe is not difficult and seems to be a good way in gaining the interest of learning manipulative skills and letter forming for early readers and writers. However this product is not limited to young children and may appeal to several different age groups. The option for removing the chalk from the shoe is also a unique feature to help keep children from writing and drawing in areas that may be prohibited by law. Most importantly the chalk shoe enables children to use their creativity and imagination in the field of art.

SUMMARY OF THE INVENTION

An active footwear with a piece of removable chalk embedded in this specific area located in the forefoot toe portion of a shoe sole intended to broaden the field of art for young children.

BRIEF DESCRIPTIONS OF DRAWINGS

The accompanying drawings, illustrate several aspects of the invention and together with the description, serve to explain the principles of the invention. A brief description of the drawings is as follows.

Figure 1:
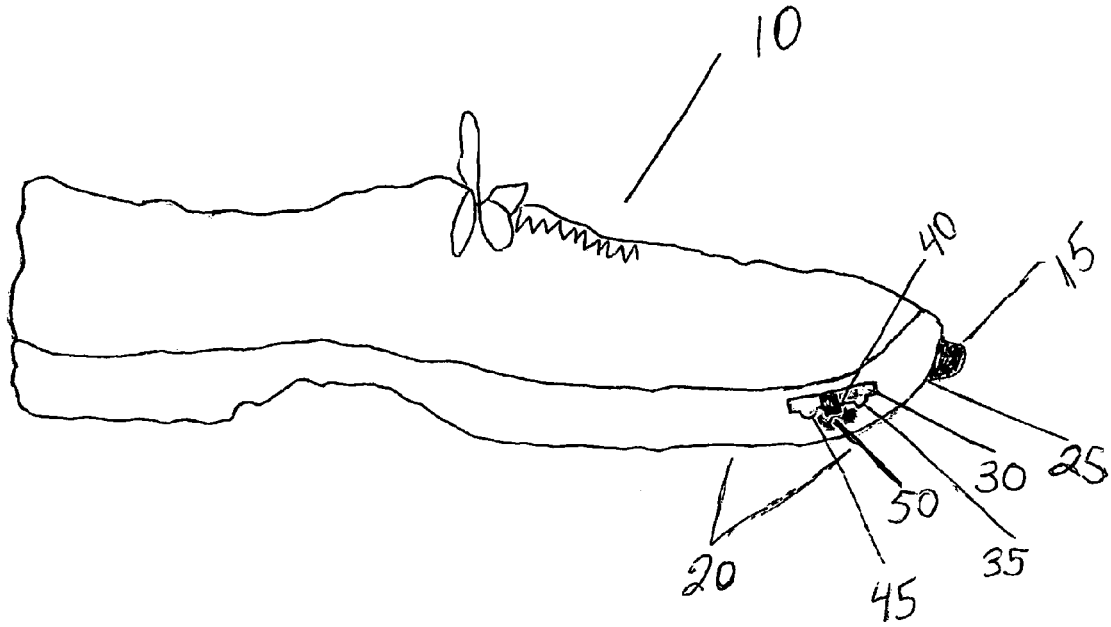
FIG. 1 is a side view of the present invention which is the chalk writing shoe and shows a chalk embedded inside the forefoot toe portion of the shoe's sole with only a portion of the chalk visible.
Figure 2:
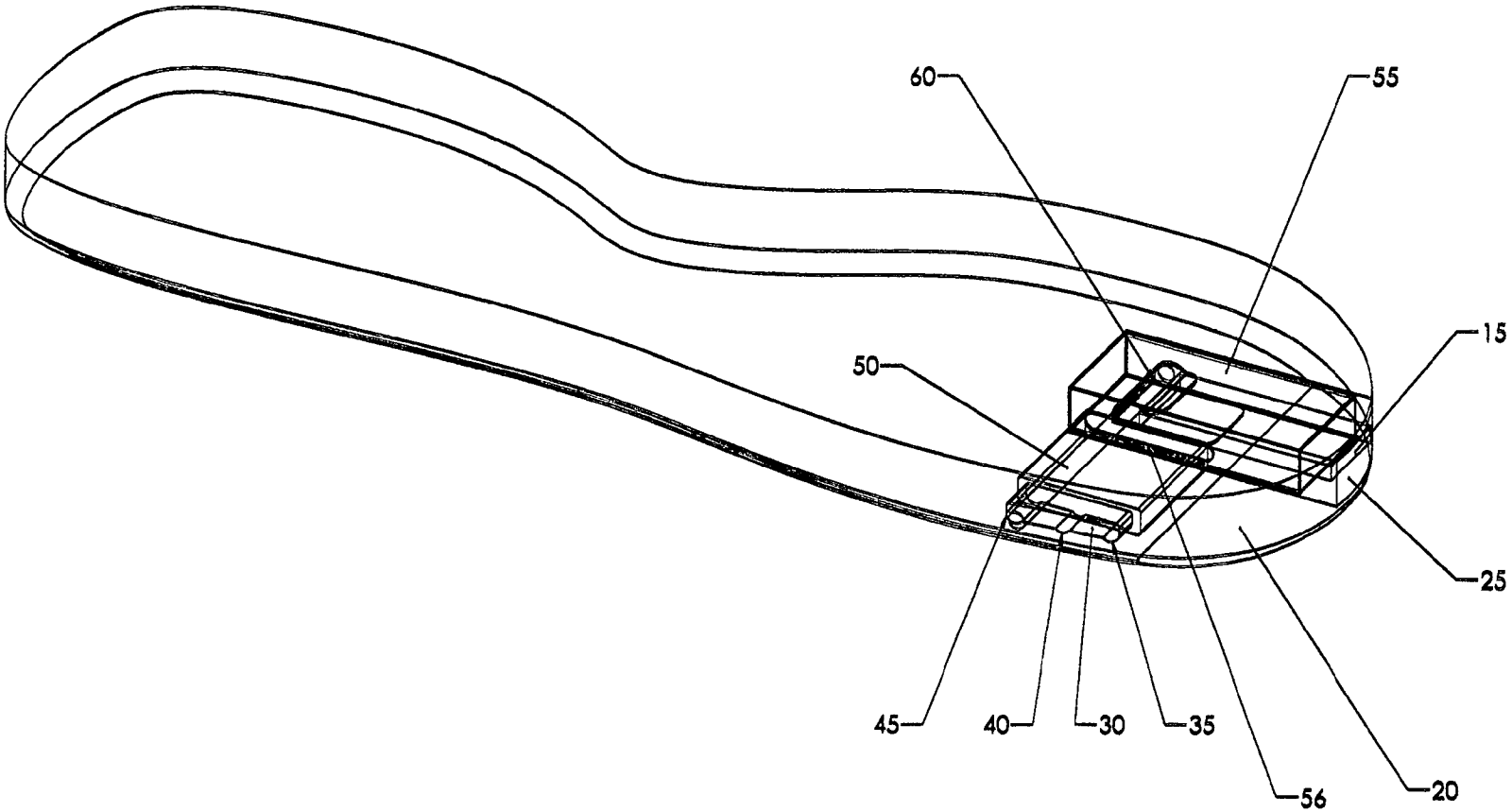
FIG. 2 is a cross section view showing the inside of the chalk shoes sole.
Figure 3:
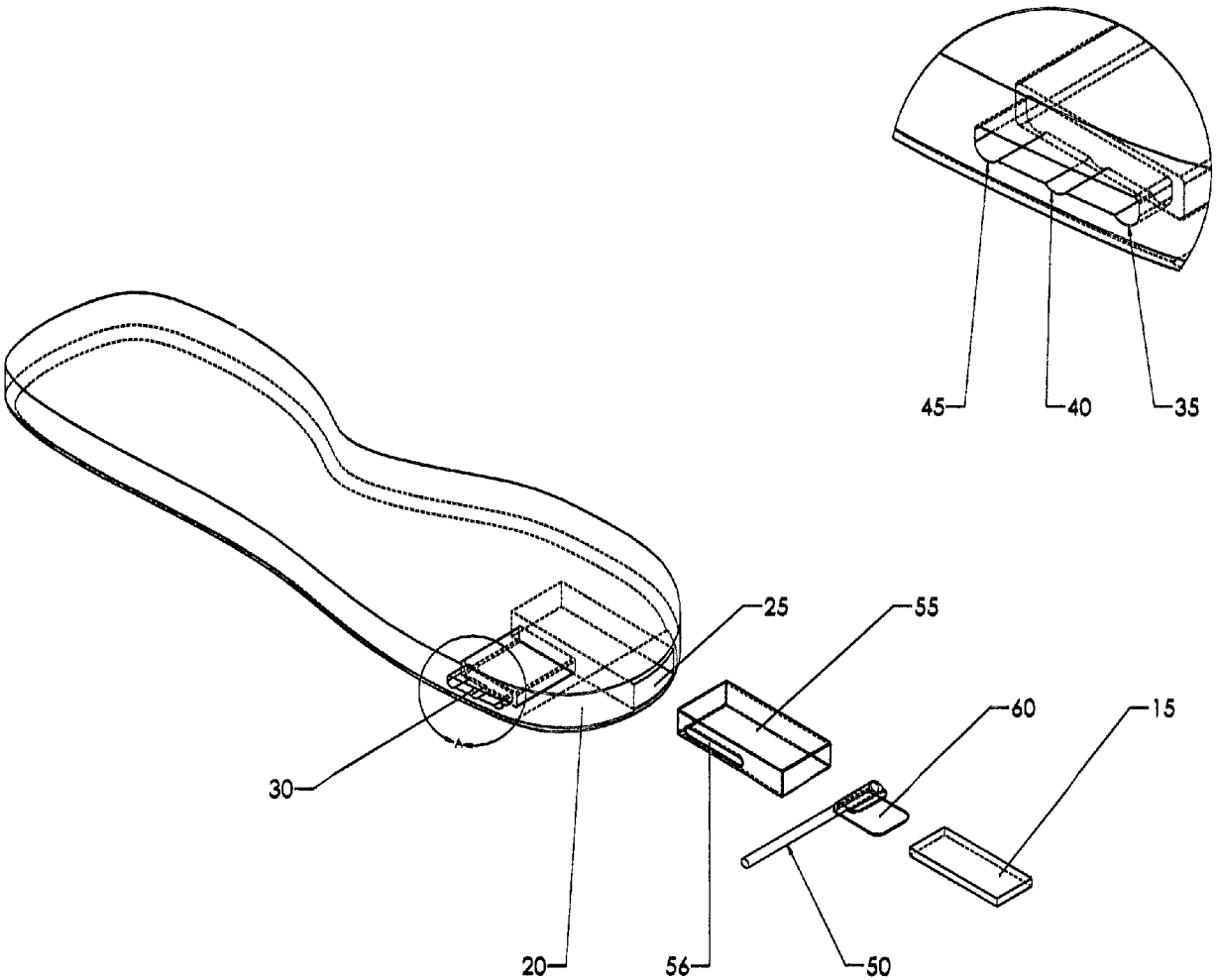
FIG. 3 is a exploded view of FIG. 2, showing each individual component of the inventions mechanism.

10—the chalk shoe
15—the chalk
20—the forefoot portion of the shoes sole
25—chalk opening in the sole
30—a thin opening created within the forefoot sole of the chalk shoe for the adjustment lever.
31-40-45—are small notch made from the sole of the shoe for the chalk lever
50—chalk adjustment lever
55—metal chamber/shaft that is like a sleeve for protecting the chalk
56—a slot cut through the chamber/shaft for the adjustment lever to go through
60—the chalk holding clamp Detailed Description of Chalk Walkers The best way to describe the present invention is an article of footwear containing a writing implement 15 in the forefoot portion of the shoes sole 20 referring now FIG. 1, the present invention an article of active footwear 10, containing 15 a piece of removable chalk inside 20 the forefoot sole portion of article 10, enable the wearer to go from walking to drawing or writing with a tilt of the foot. The wearer can cause the chalk 15 to make contact with a surface by applying light pressure and tilting the toe area of the shoe 10 slightly toward the ground. The present invention as shown in FIG. 1, also enables the wearer to remove the writing implement 15 from the opening 25 while still wearing it. Allowing the wearer to change colors of chalk if desired. As shown in FIG. 1, the chalk 15 has a sliding lever 50, that pushed the chalk 15 up and out to assist in manual removal by the wearer. In some situations the wearer may not be permitted to wear chalk 15 on a said premises or during certain social situations. A wearer might also be required to remove chalk 15 form the shoe in areas prohibited by law, therefore, the chalk shoe 10 of FIG. 1, remains stable and can be worn with or without the chalk 15 inside. (See FIG. 2, 55) 55 shown in FIG. 2 as the chamber/shaft which is a sleeve that holds the chalk 15 and also keeps the sole stable because it is comprised of metal material and is permanently fixed inside article 10. Shaft 55 is not visible to the eye from the outside of shoe article 10 as shown in FIG. 1. The chalk adjustment lever 50, of FIG. 1 is a chalk moving mechanism that enables the wearer to manually slide the chalk 15 up or back. In FIG. 1, a small portion of lever 50 is visible. A full view of the chalk adjustment lever 50 is shown in FIGS. 2 and 3. Adjustment lever 50 is therefore shown on the outer portion of 10 as in FIG. 1. Through a thin opening 30 created within the forefoot sole 20 of article 10 and is only partly visible from the outer side of article 10. For example, if the wearer were wearing the chalk shoe 10 on the right foot, lever 50 would be slightly visible on the right outer side of the forefoot sole 20. In addition slot 30 enables lever 50 to remain stable in sole 20. Wherein the lever 50 is firmly sandwiched in between opening 30, which is part of sole 20. Along the bottom of 30 are three notches 35, 40, and 45, which are integral to the forefront sole 20, which hold the adjustment lever 50 in the desired position. Lever 50 is also held in place by slot 56, of FIG. 2. Movement of adjustment lever 50, which in turn is connected to a clamp 60 that holds chalk 15, together they move the chalk 15 which is inside chamber/shaft 55. (shown in FIGS. 2 and 3) When 50 is held in the notch of 35, 40, or 45, lever 50 stay fixed in its location until the wearer manually adjusts lever 50 within the slot of 30. Wherein the hole opening of 30 being part of the forefoot sole 20 of article 10 in FIG. 1. Furthermore, as shown in FIG. 1, the chalk shoe 10 typically looks average and if chalk 15 were retracted in position 45 of article 10, using lever 50, or removed from 25, this article of footwear 10 would not be obvious to ones eye that it in fad is also a writing implement or drawing device. Therefore, article 10 can be worn most anywhere on most any casual occasion as part of a regular wardrobe for children teens and adults.

Referring now, FIG. 2, the present invention showing a cross section view of the inside of the forefoot sole 20, which is also shown as the same 20, which is part of 10 in FIG. 1. Wherein 55 a metal chamber/shaft is fixed to the sole 20 and imbedded inside the chalk opening 25, not being visible form the outside of sole 20. Chamber/shaft 55 made out of metal material surrounds 15 and provides a stable environment to prevent 15 from being damaged. Inside 55 there is a clamping device 60 made from stable material and fixed onto lever 50 enabling clamp 60 and lever 50 to slide the chalk 15 that is inside 55. The clamping device 60 shaped an configured for holding chalk 15 securely inside chamber/shaft 55. Furthermore, FIG. 2 dearly shows that clamp 60, lever 50 and chalk 15 move as a unit inside the chamber/shaft 55. FIG. 2 also shows a view of slot 56, a slot through 55 on one side to guide 50 and allow access for 50 to connect to 60.

Now referring FIG. 3, an exploded view of FIG. 2 to show each individual component of the assembled mechanism 20 through 60 and chalk 15 which are assembled inside of article 10 in FIG. 1. To remove chalk 15 the wearer must use lever 50 to slide chalk 15 forward and pull the chalk 15 out of the clamp 60 for replacement. To add a new piece of chalk 15 the wearer must place the new chalk 15 inside of clamp 60 to hold chalk 15 firmly in place so chalk 15 will stay in chamber 55 while the wearer is running or engaging in active movements such as exercise.

Alternate variations of the components of the invention not shown in FIGS. 1 through 3 should be readily accepted as part of the chalk shoe invention. For example, various sizes shapes and colors of chalk in the specific forefoot sole area 20 of a shoe article 10. Various sizes of chalk opening areas and sliding mechanisms for the reason of fitting all different shoe types and sizes. Alternative chalk moving and or sliding mechanisms are also optional features of the chalk shoe invention.

I claim:

1. An active footwear with a piece of chalk embedded inside a toe portion of a sole of the shoe comprising;

a piece of removable chalk;

a sole;

a forefoot sole area of the shoe containing a sleeve permanently fixed inside the shoe and integral with the sole, creating a permanent opening in the forefoot of the shoe for housing the piece of chalk, said piece of chalk being clipped into the opening inside the permanent metal sleeve;

a chalk adjustment lever connected to a clamp attached through a side of the shoe sole and integral with the sleeve, said lever, clamp and sleeve used as a unit to manually slide the piece of chalk forward or backward within the shoe;

wherein the adjustment lever is visible and operable from the outside of the shoe but the sleeve is completely concealed within the shoe; wherein the sleeve, adjustment lever and clamp are permanent elements of the shoe design, however the piece of chalk can be removed or replaced and the footwear remains stable and can be worn with or without the chalk inside.

2. The active footwear of claim 1, wherein the sleeve is made of metal.

* * * * *